United States Patent [19]

Nakagawa

[11] 4,324,313

[45] Apr. 13, 1982

[54] EXPONENTIAL HORN FOR USE IN HORN-TYPE LOUDSPEAKERS

[76] Inventor: Tomiyo Nakagawa, 65 Kasuga Ouji, Ryoutsu-shi, Niigata, Japan

[21] Appl. No.: 151,444

[22] Filed: May 19, 1980

Related U.S. Application Data

[63] Continuation of Ser. No. 18,715, Mar. 8, 1979, abandoned.

[30] Foreign Application Priority Data

Aug. 1, 1978 [JP] Japan ..... 53-94275

[51] Int. Cl.[3] ..... G10K 11/00

[52] U.S. Cl. ..... 181/192; 181/187

[58] Field of Search ..... 181/177, 187, 192, 195, 181/193, 194

[56] References Cited

U.S. PATENT DOCUMENTS

| | | | |
|---|---|---|---|
| 1,397,733 | 11/1921 | Herzog | 181/192 |
| 1,415,462 | 5/1922 | Morrell | 181/177 |
| 1,468,437 | 9/1923 | Benoit et al. | 181/192 |
| 1,874,733 | 8/1932 | Zwikker | 181/192 |
| 2,690,231 | 9/1954 | Levy et al. | 181/192 |

OTHER PUBLICATIONS

"Wide-Angle Dispersion of High-Frequency Sound", by Abraham B. Cohen, *Audio Engineering*, Dec. 1952, pp. 24-25, 57-59.

*Primary Examiner*—L. T. Hix
*Assistant Examiner*—Benjamin R. Fuller
*Attorney, Agent, or Firm*—Koda and Androlia

[57] ABSTRACT

Herein disclosed is an exponential horn for use in a horn-type loudspeaker, of which the mouth is in the form of an ellipse and the longitudinal cross-section of the horn intersected in the direction of the semi-major axis of the ellipse shaped mouth describes a V-shape of a larger included angle.

2 Claims, 3 Drawing Figures

EXPONENTIAL HORN FOR USE IN HORN-TYPE LOUDSPEAKERS

This is a continuation of application Ser. No. 018,715, filed Mar. 8, 1979, now abandoned.

FIELD OF THE INVENTION

The present invention relates to an exponential horn for use in a horn-type loudspeaker, and its object is to provide a spherical wave horn which is adapted to reproduce sounds with an improved faithfulness.

SUMMARY OF THE INVENTION

In accordance with the present invention the exponential horn comprises a duct of a gradually increasing vertical cross-section and ending with a mouth substantially in the form of an ellipse, and the cross-section of the horn intersected by a plane which passes the longitudinal axis of the horn and the semi-major axis of the ellipse defines substantially a V-shape or fan shape of a larger included angle.

In accordance with an aspect of the present invention, the included angle of the longitudinal V-shape cross-section is much larger than a right angle.

In accordance with another aspect of the present invention, the oblique sides of the longitudinal V-shape cross-section is substantially rectilinear.

In accordance with a further aspect of the present invention, the cross-section of the horn intersected by another plane which passes the longitudinal axis of the horn and the semi-minor axis of the ellipse defines substantially a V-shape of a smaller included angle, and the oblique sides of the V-shape section are curvilinear.

DETAILED DESCRIPTION OF THE PREFERRED EMBODIMENT

Figure 1:
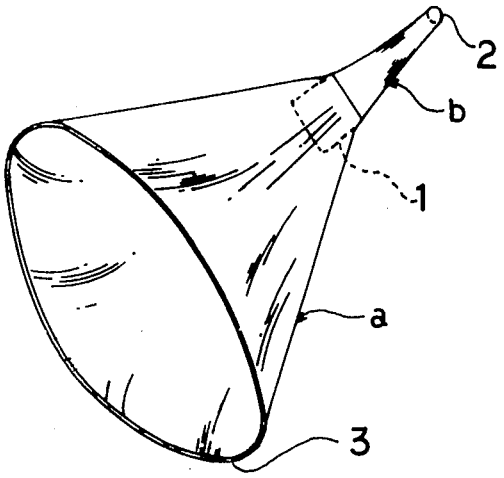
FIG. 1 is a schematical view of a horn in accordance with the present invention.
Figure 2:
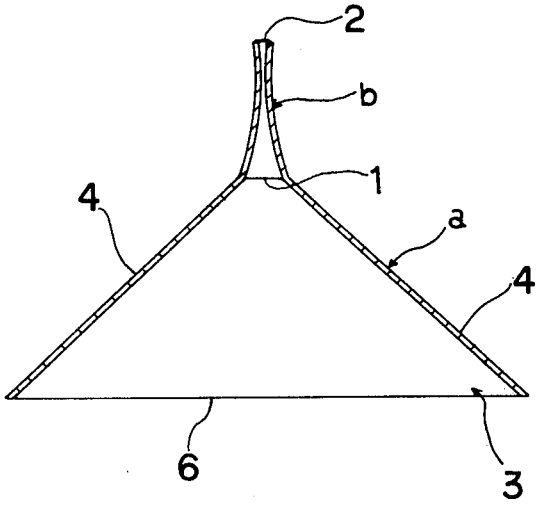
FIG. 2 is a sectional plane view of the horn taken along the plane which passes the longitudinal axis of the horn and the semimajor axis of the ellipse-shaped mouth of the horn.
Figure 3:
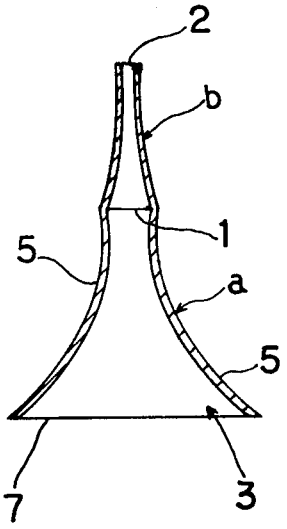
FIG. 3 is a sectional side view of the horn taken along the plane which passes the longitudinal axis of the horn and the semiminor axis of the ellipse shaped mouth.

Referring to FIG. 1, an acoustic device in accordance with an embodiment of the present invention includes a horn (a), and a throat (b) connected at the front end thereof to a rear opening (1) of the horn and operately connected at the rear end (2) thereof to a driver unit (not shown). As shown in FIGS. 2 and 3, the throat (b) has a similar geometrical configuration to those of the oridinary horn, that is, the outer diameter of the throat progressively increases from the rear end (2) towards the front opening (1) thereof. The rear end (2) of the throat (b) may open in the form of a circle, and the rear end (1) of the horn (a) may open in the form of an ellipse, circle, square or the like.

The horn (a) has at the front end thereof an opening (or mouth) (3) in the form of an ellipse or the like. As shown in FIG. 2, when intersecting the horn (a) by a plane including the longitudinal axis of the horn in the direction of the semi-major axis of the ellipse-shaped opening (3), the cross-section contours a V-shape or the like. The included angle of the V-shape section is preferably larger than a right angle. The base side (6) is the longest side and the oblique sides (4) is rectilinear. On the other hand, as shown in FIG. 3, when intersecting the horn (a) by a plane including the longitudinal axis of the horn in the directon perpendicular to the semi-major axis of the ellipse-shaped mouth (3), the resulting V-shape section includes a base side (7) of the shortest length and two curvilinear oblique sides (5). The horn (a) is also of cross-section gradually increasing towards the front end (3) in the same manner as those of the well-known exponential horn. Thus, the horn (a) has a unique geometrical form of which the peripheral contour of the horn varies smoothly from rectilinear sides to curvilinear sides.

Generally the horn-type speaker is effective to endow a large radiation resistance with a relatively small driver unit and has a possibility to make a faithful sound reproduction. The loudspeaker of this type, however, involves three problems which have heretofore prevented the attainment of better sound reproduction. Two of these concern the nature of the horn construction and the remaining one does the field of sound waves emitted from the horn. The present invention resolves these problems and greatly improves the characteristic of the horn as explained in detail hereinafter.

The first problem derives from one of the elementary characteristics of the horn. The performance of the horn was theoretically made clear in the relatively recent times as one of the results of acoustic theory. However, the theory deduced therein is analogous to one based on the assumption that waves in the horn may be considered as plane waves. Certainly, the wave front increases slowly and the sound wave propagates in the same form near the rear end of the horn, and thus the sound wave can be assumed as plane wave at that point. On the other hand, at the point where the diameter of the horn becomes large, the wave surface conspicuously increase. Thus the sound wave propagates in the same direction as that of particle velocity of the medium (air) only at the vicinity of the center (axis) of the wave surfaces and does not in the same direction at the periphery of the wave surfaces. Then, the form of sound wave varies in the course of propagation. Accordingly, first-order beam on the wave surfaces at the mouth is not uniform in wave form nor in magnitude.

This problem is not a fatal defect in the acoustic device, but it is desirable that waves on the wave surface at the mouth should be a uniform spherical wave. Only the conical horn fulfils this condition, however, it has not been popularly employed because of the defect that the real term of its throat impedance is low in the low range of sounds. As explained hereinafter in connection with the third problem, the first problem of the above is resolved according to the present invention by employing a horn (a) having a mouth (3) in the form of an ellipse or the like, namely modifications of ellipse such as a form of convex lens and etc., and having a longitudinal centrally intersected cross-section in the form of a V-shape having a larger included angle.

The second problem concerns reflection and diffraction due to the fact that the actual horn has a definite length. Namely, on waves at the inner surface of the horn is imposed a boundary condition that the components in the normal direction of the displacement $\xi$ of the medium and the particle velocity $\xi$ are equal to zero. But, at the instant when the wave surface arrives at the mouth, the boundary condition suddenly changes to that the displacement becomes unrestrained and that the condensations is zero. Hence, all sites of the periphery of the mouth become the source of disturbance and spherical waves (called "diffraction waves" herein) are emitted therefrom. The disturbance emitted at the periphery of the wave surfaces at the mouth, namely the deviation of s, is moving from the periphery to the center. In this case, when the wave length is larger as compared to the length of the mouth, the deviations of s on the same surfaces at the mouth can be considered to be in phase.

This condition is identical to the condition of an interface between two mediums, where a part of the first-order waves having arrived at the mouth is emitted to the free space and the other is reflected. As the wave length gets shorter, the phases of the deviations of s become more random and averaged, and hence the reflecting waves become weakened. On the other hand, the diffraction waves emitted at the periphery are not weakened when the wave length is shorter. Accordingly, the reflecting wave has an important influence in the low range of sounds while the diffraction wave does in the high range.

The reflecting wave moves in the adverse direction through the horn and arrives at the throat. It results in irregularity of frequency characteristic of the throat impedance and also in irregularity of frequency characteristic of the acoustic energy emitted from the mouth. The reflection deteriorates the sound quality. The sound reproduced by a horn of a high reflection coefficient is conspicuously different in quality from the natural sounds which are of damped vibration. This distortion of sounds by reflection can not be eliminated by any pre-amplifier.

Heretofore, it has been considered that, in case of the exponential horn of a circular mouth, the included angle smaller than right angle is sufficient for the horn to reproduce faithful sounds, and the horns of such construction have been marketed. This is wrong. For the purpose of reducing the reflection coefficient of the horn not so as to deteriorate the sound quality, the diameter of the mouth (in case of the circular mouth) should be long to an extent comparable to the wave length of the cut-off frequency. This length of the mouth can be estimated from the horn in which the deviations of s on the wave surfaces at the mouth are averaged. It may be ascertained by the approximate value of the throat impedance which is calculated by using the radiation impedance of a circular piston or respiration sphere in lieu of the mouth impedance. Otherwise, it may be ascertained by actual horns of variable mouth.

The problem of reflection can be resolved by a horn of a large diameter, but a large horn is unsuitable for the low range of sounds. However, high power and better faithfulness can be effectively attained for low sounds, if a horn speaker of a large diameter is used with input of an appropriate narrow range. The diffraction of waves also raises the third problem.

The third problem concerns the diffraction figure of the sound field generated by the second-order waves emitted at the mouth of the horn. To try to understand this problem, let us consider the diffraction of light. Light emitted in a uniform isotropic medium and sound propagated in the air are the waves of the simplest form both of which can be expressed by the wave equations of a same type. There is no essential difference between them except for the difference in oscillation (frequency). Light is a transversal wave and sound is a logitudinal wave, however, such a difference is not essential in the study of the diffraction of waves. Accordingly, if one ignores the difference in frequency, the principles and laws governing the behavior of light in an isotropic medium are applicable to sound in air.

The plane wave of homogeneous light incident upon a small circular hole into a dark room projects a diffraction figure of concentric circles on a screen which is perpendicular to the radiation axis of light in the dark room. The disturbance caused by the shielding wall is limited to the very narrow portion of the periphery around the hole since the wavelength of light is very short as compared to the dimension of the hole. Hence, the wave equation of this case can be resolved with an adequate assumption that the diffraction on the periphery of the hole is identical to that of the first-order incident waves.

The diffraction figure generated by the plane wave of a homogeneous light incident upon a hole is expressed by the following wave function (which is the space term of the wave function) with the phase dependence removed.

$$u(\rho,z) = \mu_o \int_o^{\infty} J_o(\mu\rho)J,(\mu a)e^{i\sqrt{k2\mu 2z}}\,d\mu \qquad \text{(I)}$$

wherein;

$\rho$,z are coodinates of the circular cylindrical coordinates $(\rho,\theta,z)$, $\mu_o$ is the space dependence of the incedent wave on the hole, a is the radius of the hole, k is the number of waves which are included in the length of the even multiple of $2\pi$ by the unit length.

In the case of sound wave, the aforementioned assumption does not hold, and thus the correct solution can not be obtained. However, the diffraction figure is apparently formed in the sound field which is developed by the sound from a horn. (When a pure tone is emitted from the mouth of a horn, a pattern that the intensity of the sound repeatedly varies in the sound field. This pattern is herein called the "diffraction figure" by the optical terminology, though the sound is invisible.

For the simplification of illustration, it is supposed that the mouth of a horn defines a single plane and is fitted in a flat baffle. Under this condition, the sound field which is generated by the emission of a pure tone (a continuous sine wave) is given by $$\phi(x',y',z')e^{-iwt} = -\frac{1}{2\pi}\int_s \frac{\partial\phi}{\partial\eta}\,\frac{e^{i(kr-wt)}}{r}\,d\Delta \qquad \text{(II)}$$

wherein $\phi$ is the space dependence of the velocity potential, x', y', z' are the coordinates of the observation point, s is the plane defined by the mouth (this plane should be flat), $$\frac{\partial}{\partial\eta}$$

is the differential coefficient in the positive direction normal to the plane s, k is the number of waves, and r is the distance between the observation point and an arbitrary point (x, y, z), which is expressed by $$r = \sqrt{(x' - x)^2 + (y' - y)^2 + (z' - z)^2}$$

The diffraction figure is obtained by Equation (II) with the time and phase dependences removed.

Horn putted in the free space developes a more complicated diffraction figure which can not be expressed by such an equation but is considered to be analogical to the aforementioned one. A horn of which the mouth defines a curved plane also developes a similar diffraction figure.

Equation (II) shows that the sound field can be determined when the distribution of particle velocity on the mouth plane is given. However, the wave motion is interfered with by the disturbance emitted at the periphery of the mouth and becomes too complicated to correctly realize the behavior thereof. Thus, the integration of Equation (II) can not be effected. The outline of the sound field can be deduced from Equation (II) although Equation (II) is not solved.

Namely, when the mouth of the horn is in the form of a square or a square having curvilinear base, the integration of Equation (II) has apparently maximal and minimal values at many particular points. Further, a horn of a circular mouth developes a clear diffraction fugure since the radius a is a constant value.

The plane wave of a homogeneous light incident upon a circular hole developes a diffraction figure which is defined by Equation (I). In the case of a hole in the form of an ellipse, however, the general solution of Equation (I) can not be obtained. In such a case, the only way to obtain an approximate solution is to divide the area of the ellipse into a multiple of definite elements smaller than the wavelength and then to make the integration over the elements by computor. It is readily understood that the diffraction figure is vague, since the coefficient corresponding to the radius of a circle is random and it makes the value of integration averaged. Hence, we obtain a conclusion that, as the mouth of a horn, ellipse or the like is the most appropriate form while square is the most inappropriate.

The phenomenon that the sound field yields a diffraction figure is identical to that the sound propagates in a different direction from that of the particle velocity. The sound wave varies its form in the course of propagation, though the directions of the sound propagation and the particle velocity are consistent with each other at certain points, unless they do at the all points in the sound field. The diffraction figure is the formation of a pattern that the intensity of sound varies repeatedly at points in the sound field, and the pattern varies complicatedly according to the frequency. Thus, the sound spectrum varies at sites in the case of a sound of usual wave form. Accordingly, the fact that the diffraction figure is not caused signifies that sound wave propagates as a spherical wave in the field, since any usual sound varies its wave form in the course of propagation.

In order to accomplish a good acoustic reproduction, it is necessary to fulfil three requirements, namely high power, high efficiency and good faithfulness. For obtaining a high level of acoustic power in the low range of sounds, it is necessary to use a wide radiation area which in return poses serious problems. Horn-type speaker is one of measures to solve the problems. Loudspeaker is seemed to be sound sources which are distributed on a curved surface of a definite extent. Similarly, the horn is considered as spots of sound sources (dipole sound sources) distributed on an arbitrary curved surface of which the periphery is constituted by that of the horn mouth. The sound field can be considered as spherical wave at the site remote from the sound source on condition that the extent of sound source is narrower as compared to the wavelength (if it is circle, $ka<1$, where "a" is the radius. However, since the horn-type speaker requires a large area of mouth to lessen the reflection coefficient, the above condition is inapplicable to the horn-type speaker for the high range of sound.

When the sound source is distributed uniformly around the all of the surface of a sphere, the sound field is formed in sphere symmetry and the direction of the sound propagation accords with that of the particle velocity at any site of the field, and it follows that the sound propagates without varying it's wave form.

On the other hand, when the sound source is distributed on any curved surface other than the spherical surface, it developes a diffraction figure (in this specification, the term "diffraction figure" is used as a synonym of the interference fringe, although the sound source of a first order wave developes only the interference fringe), and thus the sound wave propagates varying its wave form. It is the same with a sound source which is distributed symmetrically on a part of spherical surface. However, it is desirable that the sound source is distributed on a portion of spherical surface having a solid angle as large as possible. Such a desirable sound source includes only the following three cases: the second-order wave from the source which can be considered to be spot sources of smaller extent as compared to the wavelength; the aspiration sphere end; the conical horn.

As described in detail hereinbefore, the horn of the present invention does not develope a clear diffraction figure, because the mouth is in the form of an ellipse or the like and as such the values of integration of Equation (II) are averaged. Hence, the sound wave propagates substantially without varying its wave form at any site of the sound field.

Further, the cross-section of the horn intersected by a plane which passes the longitudinal axis of the horn and the semi-major axis of the ellipse exhibits a V-shape or the like having a large included angle, namely, the base side of the cross-section is the longest side and the oblique sides are rectilinear. Thus, the wave near the horizontal plane which includes the axis of the wave surface at the mouth becomes in a condition similar to a uniform spherical wave. Hence, the horn of the present invention can yield a sound field similar to uniform spherical waves in the listening area which is allowed to have a relatively narrow vertical extension and is required to have a relatively wide horizontal extension.

Accordingly, the present invention resolves the prior art problems and provides a horn having both of merits, that of the ordinary horn (such as exponential horn) and that of the conical horn. Namely, the horn of the present invention can faithfully transmit the sound wave emitted by the throat (2) with a high effeciency to the listener.

I claim:

1. An exponential horn for use in a horntype loudspeaker, comprising a duct of gradually increasing vertical cross-section and ending with a mouth substantially in the form of an ellipse, and the cross-section of the horn intersected by a plane which passes through the longitudinal axis of the horn and the semi-major axis of said ellipse defining a substantially V-shape of a large included angle and of substantially straight sides and the cross-section of the horn intersected by a plane which passes through the longitudinal axis of the horn and perpendicular to the semi-major axis of said ellipse is a curved line.

2. An exponential horn as claimed in claim 1, wherein said included angle of the cross-section of the horn intersected by the plane which passes the longitudinal center line of the horn and the semi-major axis of the ellipse is larger than a right angle.

* * * * *